US005312099A

United States Patent [19]

Oliver, Sr.

[11] Patent Number: 5,312,099

[45] Date of Patent: May 17, 1994

[54] BALL RETURN APPARATUS FOR BASKETBALL GOAL

[76] Inventor: Dan H. Oliver, Sr., 1031 SE. 43rd, Topeka, Kans. 66609

[21] Appl. No.: 2,812

[22] Filed: Jan. 11, 1993

[51] Int. Cl.[5] ..... A63B 69/00

[52] U.S. Cl. ..... 273/1.5 A

[58] Field of Search ..... 273/1.5 A, 396, 397; D21/201

[56] References Cited

U.S. PATENT DOCUMENTS

| | | | |
|---|---|---|---|
| D. 214,066 | 5/1969 | Benigno . | |
| D. 280,755 | 9/1985 | Cochran . | |
| D. 284,599 | 7/1986 | Cochran . | |
| D. 293,125 | 12/1987 | Cochran . | |
| 1,574,201 | 2/1926 | Lynch . | |
| 1,765,269 | 6/1930 | Hatley | 273/1.5 A |
| 1,924,757 | 8/1933 | Shisoff . | |
| 2,617,653 | 10/1952 | Keller . | |
| 2,838,308 | 6/1958 | Polite . | |
| 2,889,149 | 6/1959 | Williams . | |
| 3,233,896 | 2/1966 | King | 273/1.5 A |
| 3,561,762 | 2/1971 | Russell . | |
| 4,291,885 | 9/1981 | Cohen | 273/1.5 A X |
| 4,667,957 | 5/1987 | Joseph . | |
| 4,805,917 | 2/1989 | Cochran et al. | 273/397 |
| 4,838,549 | 6/1989 | Woodall | 273/1.5 A |
| 5,016,875 | 5/1991 | Joseph | 273/1.5 A |
| 5,129,648 | 7/1992 | Sweeney et al. | 273/1.5 A |
| 5,160,138 | 11/1992 | Sanders | 273/1.5 A |
| 5,171,009 | 12/1992 | Filewich et al. | 273/1.5 A |

FOREIGN PATENT DOCUMENTS

| | | | |
|---|---|---|---|
| 7412652 | 12/1974 | France . | |
| 1319878 | 6/1987 | U.S.S.R. | 273/1.5 A |

*Primary Examiner*—Paul E. Shaprio

*Attorney, Agent, or Firm*—Litman, McMahon & Brown

[57] ABSTRACT

A ball return apparatus for use with a basketball goal includes an elongated framework including an upstanding back pole having a hook at the top to removably engage a hoop support bracket of a conventional basketball goal assembly. A pair of chute support arms extend laterally from the top of the back pole and cooperate with a longitudinal portion of the framework to support a ball return chute which extends toward a front of the frame. The longitudinal portion of the framework is pivotally connected to a back portion to enable the apparatus to be angled relative to the goal assembly. A vertically adjustable defense bar is mounted in a front portion of the frame and forms a barrier over which a player must shoot a basketball to encourage and develop a proper basketball shooting technique.

20 Claims, 2 Drawing Sheets

Fig. 2.
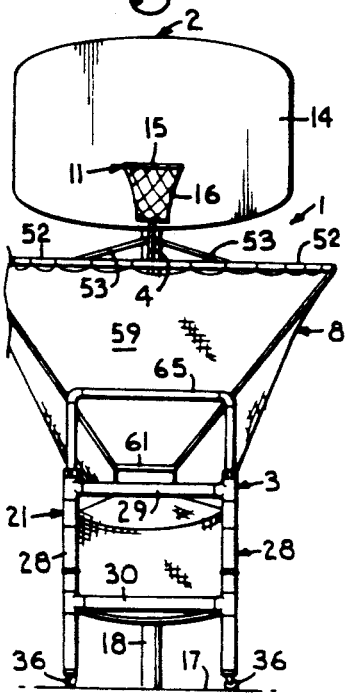
Fig. 1.
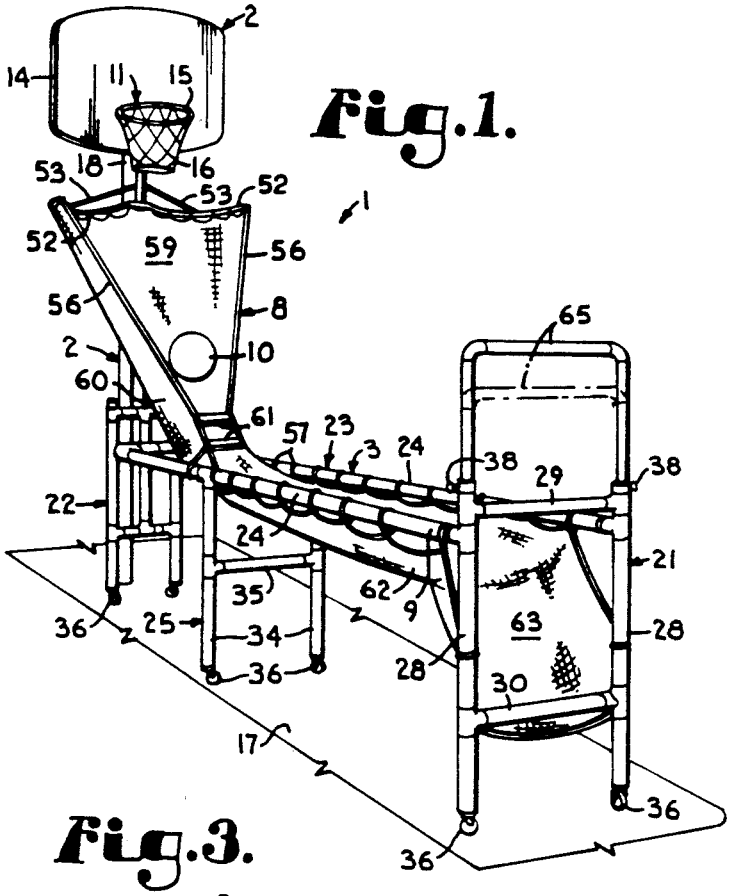
Fig. 3.
Fig. 4.
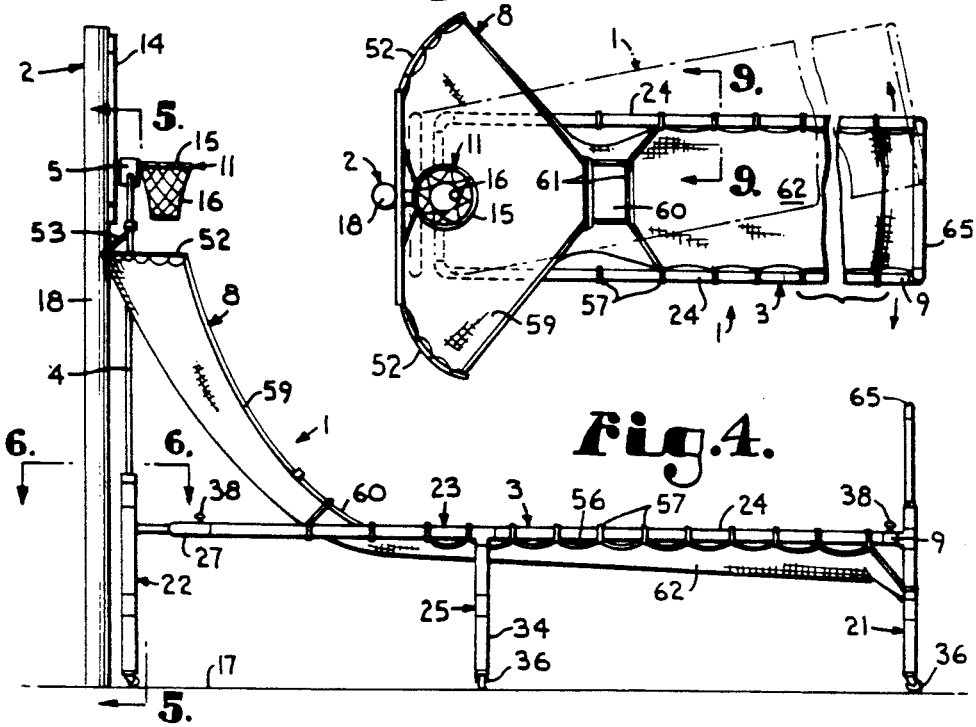

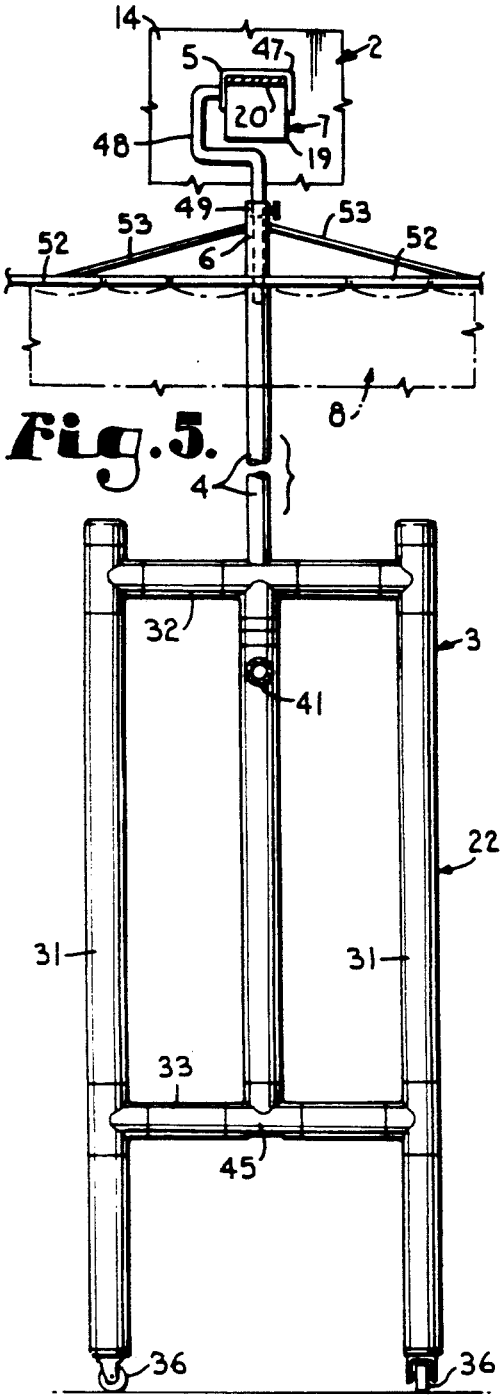
Fig.5.
Fig.6.
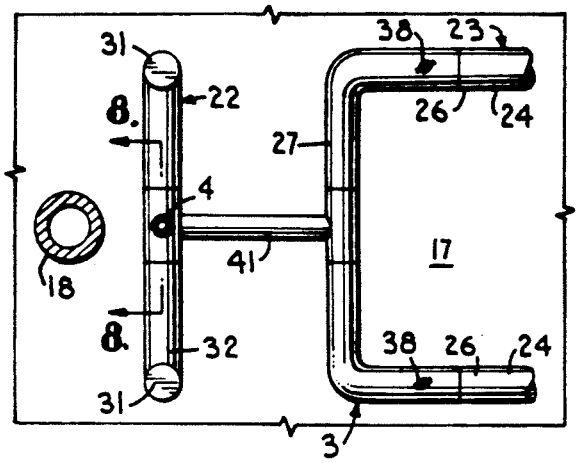
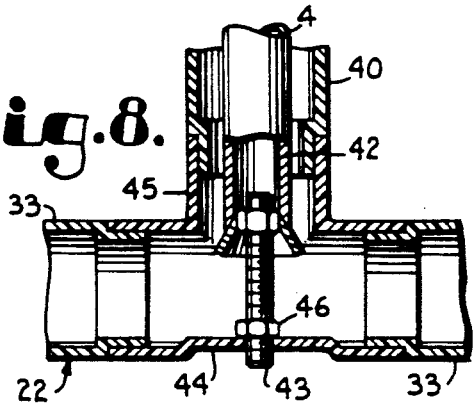
Fig.8.
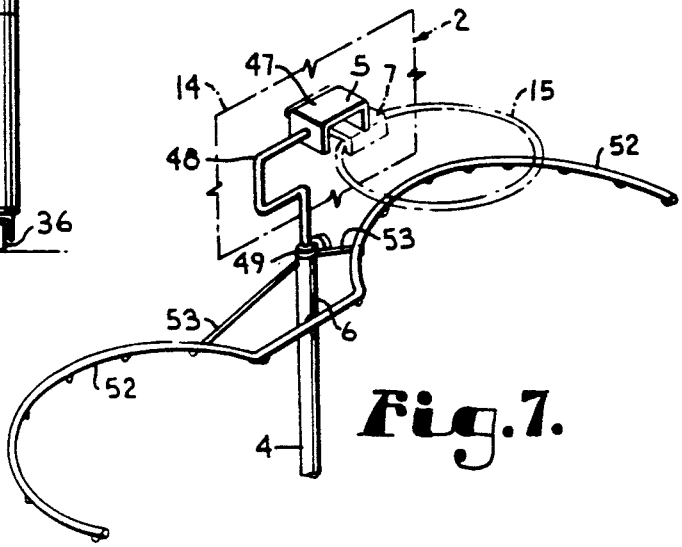
Fig.7.
Fig.9.
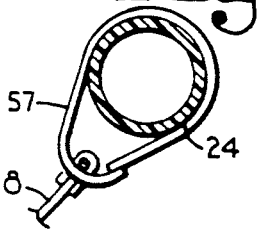

BALL RETURN APPARATUS FOR BASKETBALL GOAL

BACKGROUND OF THE INVENTION

In sports, as in many other areas, practice is required to develop skills to their highest potential. In basketball, basket shooting is of prime importance since scoring is based on sinking baskets. Shooting proficiency is desirable for all players, since all players in a game may have an opportunity to shoot, either during normal play or for free throws. When a basketball is shot toward the basket, it may return to the shooter; more often, however, it lands at a position which requires the shooter to retrieve the ball or for someone else to return it to the shooter. During team practice, several players may cooperate whereby turns are taken in shooting and ball returning. However, when a player practices alone, a considerable amount of tedium can result from the continual need to chase down the ball.

There have been a number of arrangements devised to facilitate basketball shooting practice by returning the ball to the shooter. Some devices of this nature do not use a regulation size and weight ball or hoop or do not position the hoop at the regulation height. Such nonregulation devices do not develop muscular strength, coordination, and technique which is directly transferable to a regulation court. Other devices of this type provide a regulation size and height hoop; however, the backboard and hoop are integral to the apparatus, resulting in increased cost and complexity in setup.

An area which most of the prior basketball shot training devices do not address is proper shooting technique. It has been observed that many players tend to shoot from their hips or from in front of their faces. Such a manner of shooting blinds the shooter to the target of the shot, risks facial or eye injury, and makes defense of the shot easier for opposing players. It is generally believed that a shot with a high arch from the hands held above the head is less likely to be blocked by an opposing player and is difficult to steal without fouling the shooter.

What is needed is a basketball training device which facilitates shooting practice, which can be used with virtually any existing type of regulation basketball goal, and which has features that require the player to use good shooting technique.

SUMMARY OF THE INVENTION

The present invention provides a basketball training device which functions not only to facilitate basketball shooting practice but also has a feature which can be used to develop good shooting technique. Additionally, the ball return apparatus of the present invention can be used with virtually any conventional, regulation type of basketball goal.

The ball return apparatus includes an elongated framework including an upstanding back standard or pole with a goal hook at the top for engagement with the hoop support bracket of a basketball goal assembly to properly locate the back end of the framework. A pair of chute support arms extend laterally from the back pole and cooperate with a longitudinal portion of the framework to support a ball return chute. The fabric or net chute has a wide dimension as it extends from the support arms and descends steeply therefrom. It narrows as it reaches the longitudinal frame portion and continues toward a front end of the framework at a shallow descending angle.

The longitudinal portion of the framework is pivotally connected to a back portion of the frame, and the back pole is pivotally supported by the back portion to allow the longitudinal portion to be positioned through a range of angles relative to the backboard. The longitudinal frame portion preferably has such a length as to position a player at a free throw distance from the basket. A defense bar is mounted on the front frame portion and is vertically adjustable to provide a barrier over which the player must shoot to develop proper shooting technique. Preferably, the framework is provided with wheels or casters to facilitate moving the apparatus on a basketball court.

OBJECTS AND ADVANTAGES OF THE INVENTION

The principal objects of the present invention are: to provide an improved basketball training apparatus which facilitates practicing basketball shooting; to provide, particularly, a ball return apparatus for use in practicing basketball shooting; to provide such an apparatus which is usable with a wide variety of conventional regulation basketball goal assemblies; to provide such an apparatus including a back end frame and a front end frame supporting a longitudinal chute frame above a court surface, the back frame including laterally extending chute support arms which, in cooperation with the longitudinal chute frame support a flexible ball return formed of a fabric or net material; to provide such an apparatus in which a goal hook is mounted at a top end of a back pole supported by the back frame, the hook being adapted to engage the hoop supporting bracket of a goal assembly, to properly locate the back frame below the backboard; to provide such an apparatus in which the longitudinal frame and the back pole are pivotally connected to the back frame to enable the longitudinal frame to be positioned at a wide range of angles relative to the backboard; to provide such an apparatus with casters or wheels to facilitate movement thereof; to provide a preferred embodiment of such an apparatus wherein the length is such as to position a practicing player at a standard free throw range from the basket; to provide such an apparatus which is adaptable for extendibility for development of shooting skills from a variety of ranges from the basket; to provide such an apparatus including a vertically adjustable lateral defense bar on the front frame over which a player must shoot to develop proper shooting technique; to provide such an apparatus which encourages body elevation, off the ground, to assist enhancement of the jump shot and obtain better eye contact with which to align the shot with the goal; to provide such an apparatus which is suitable for use on indoor and outdoor basketball courts; to provide such an apparatus which is conveniently assembled and disassembled to facilitate packaging, setup, and storage of the apparatus; and to provide such a basketball return apparatus which is economical to manufacture, which is effective in use, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a ball return apparatus for a basketball goal which embodies the present invention.

FIG. 2 is a fragmentary front elevational view of the ball return apparatus.

FIG. 3 is a top plan view of the ball return apparatus with an alternative position of the apparatus shown in phantom lines.

FIG. 4 is a side elevational view of the ball return apparatus.

FIG. 5 is an enlarged fragmentary elevational section taken on line 5—5 of FIG. 4 and illustrates details of a back frame of the ball return apparatus.

FIG. 6 is an enlarged fragmentary top plan section taken on line 6—6 of FIG. 4 and illustrates details of the connection of a longitudinal chute support frame to the back frame.

FIG. 7 is an enlarged fragmentary perspective view illustrating details of a lateral chute support of the ball return apparatus and details of a hoop bracket hook.

FIG. 8 is a greatly enlarged sectional view taken on line 8—8 of FIG. 6 and illustrates pivotal connection details of a central member of the back frame to which the main chute frame is connected.

FIG. 9 is a greatly enlarged sectional view taken on line 9—9 of FIG. 3 and illustrates details of a chute connection strap by which the ball return chute is connected to members of the chute support frame.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a ball return apparatus for use with a basketball goal assembly 2 and which embodies the present invention. The apparatus 1 generally includes a framework 3 with an upstanding back standard or pole 4 having a goal hook assembly 5 (FIG. 7) at a top end 6 which is sized and shaped to engage a hoop support bracket 7 (FIG. 5) of the goal assembly 2. The framework 2 supports a basketball return chute 8 which extends from below the goal assembly 2 toward a front end 9 of the framework 3 to catch and return toward a player at the front end 9 of the goal assembly 2 a basketball 10 thrown toward a basket 11 of the goal assembly 2.

The apparatus 1 is intended for use with a regulation type goal assembly 2 including a backboard 14 and the basket 11 formed by a hoop or rim 15 and a net 16. The illustrated backboard 14 is supported above a court surface 17 by a post 18. A post supported backboard 14 is suitable for outdoor installations and is, thus, illustrated in the drawings for simplicity; however, most indoor goal assemblies 2 are supported by other means, such as by structures which deploy from an overhead position (not shown) or a weighted support structure (not shown) offset behind the backboard 14. The apparatus 1 is suitable, without modification, to virtually all types of regulation goal installations. The hoop 15 is connected to the backboard 14 by the hoop support bracket 7 which usually includes a vertically oriented backplate 19 (FIG. 5) and a forwardly projecting hoop plate 20. The bracket 7 may also include a pair of struts (not shown) extending between the backplate 19 and the hoop 15. The net 16 is supported by the hoop 15 and hangs therebelow.

The framework 3 includes a front end frame 21 and a back end frame 22 which cooperate to support a horizontally oriented longitudinal chute frame 23 above the basketball court surface 17. The longitudinal chute frame 23 is formed by a pair of elongated, parallel side rails 24 extending back from the front end frame 21 and has a middle frame 25 depending therefrom at a medial position. Back ends 26 of the side rails 24 are connected by a U-shaped back cross member 27 (FIG. 6).

The front end frame 21 is formed by a pair of laterally spaced front corner posts 28 connected by upper and lower front cross members 29 and 30. The back end frame 22 is formed similarly by back corner posts 31 connected by upper and lower back cross members 32 and 33. The middle frame 25 has a pair of middle posts 34 depending from the side rails 24 and connected by a middle cross member 35. Each of the front, back, and rear posts 28, 31, and 34 preferably has a caster 36 mounted at a lower end thereof to allow the apparatus 1 to be selectively positioned. The framework 3 is preferably formed of tubular members, such as of aluminum or steel or a synthetic resin such as polyvinyl chloride (PVC) or the like. The framework 3 may be formed with separable joints assembled using removable fasteners 38, such as cotter pins or the like, to facilitate packaging and storage.

A pivot axle 40 is pivotally connected between the upper and lower back cross members 32 and 33 of the back end frame 22 and is vertically oriented. A pivot arm 41 connects the U-shaped back cross member 27 of the longitudinal frame 23 to the pivot axle so that the longitudinal frame 23 is pivotal relative to the back end frame 22 about a vertical axis defined by the axle 40. The back pole 4 is pivotally supported in a vertical orientation by the back end frame 22 and extends through the pivot axle 40. As illustrated in FIG. 8, the lower end 42 of the back pole 4 terminates in a stud 43 which extends through an aperture in a lower plate 44 of a middle joint section 45 of the lower cross member 33 of the back end frame 22. Means such as a nut 46 on the stud 43 distributes the weight carried by the back pole 4 on the lower plate 44.

The goal hook assembly 5 is positioned at the top end 6 of the back pole 4 and is adapted to engage the forwardly extending hoop plate 20 of the hoop support bracket 7 to properly locate the back end of the apparatus 1. The goal hook assembly 5 includes an inverted U-shaped member 47 connected to an offset neck 48 which is pivotally set into the back pole 4 and has a height adjustment collar 49 thereon to allow adjustment of the vertical position of the hook member 43 relative to the back end frame 22.

A pair of chute support arms 52 extend laterally from near the upper end 6 of the back pole 4 to an extent which is, preferably, wider than the width of the backboard 14. A pair of support struts 53 connect between the upper end 6 of the back pole 4 and each of the chute support arms 52. Each arm 52 is preferably arcuate in a horizontal plane to curve back a short distance and then toward the front end 9 of the apparatus 1.

The ball return chute 8 is connected to the chute support arms 52 and extends downward therefrom and toward the front frame 21, with side edges 56 of the chute 8 connected to the side rails 24 of the longitudinal frame 23. The chute 8 may be removably connected to the support arms 52 and side rails 24 by chute connector loops 57 which are closed by means such as snaps or hook-and-loop patches. The chute 8 is preferably formed of a strong light material, such as nylon or the like, or may be formed from a netting material.

The chute 8 has a shape such that a descending portion 59 from the support arms 52 forms a segment of a funnel to provide a wide ball-receiving portion of the chute 8. A transition portion 60 of the chute 8 has the side edges 56 thereof connected by gather straps 61 to prevent a gathered basketball 10 from bouncing out of the chute 8. A return portion 62 of the chute 8 extends at a slight downward angle toward the front frame 21 where front end portions 63 of the chute 8 are connected to the front corner posts 28 of the front frame 21.

A vertically adjustable defense bar 65 is mounted in the top ends of the front corner posts 28 and forms a shot barrier over which a basketball 10 must be shot to develop a proper high-arch shot technique. The defense bar 65 may be adjusted vertically to accommodate the height of a player using the apparatus 1.

The ball return apparatus 1 has an overall length to coincide with the free throw line of the court surface 17 in front of the goal assembly 2 whereby a player may practice free throws when the apparatus 1 is oriented with the longitudinal frame 23 perpendicular to the backboard 14. Alternatively, the longitudinal frame 23 may be angled relative to the backboard 14 to provide for practice shots from other positions on the court. Angling the apparatus 1 to the backboard 14 pivots the longitudinal frame 23, the chute support arms 52, and the back pole 4 relative to the back frame 22, with the goal hook assembly 5 remaining stationary. The side rails 24 of the longitudinal frame 23 may be made extendible, and the return portion 63 of the chute also may be provided with surplus length and additional connector loops 57 so that the apparatus 1 can be extended to ranges from the basket 11 beyond the free throw range.

It is to be understood that while certain forms of the present invention have been illustrated and described herein, it is not to be limited to the specific forms or arrangement of parts described and shown.

What is claimed and desired to be secured by Letters Patent is as follows:

1. A basketball training apparatus for use with a basketball goal assembly including hoop bracket means and comprising:

(a) elongated chute frame means having a back end and a front end, supported on a court surface, and extending a selected distance;

(b) a back standard upstanding from said back end of said frame means;

(c) a ball return chute connected to said back standard and said frame means and extending toward said front end of said frame means; and (d) hook means positioned at a top end of said back standard, said hook means being adapted for removable connection to said hoop bracket means.

2. An apparatus as set forth in claim 1 wherein said frame includes:

(a) a longitudinal frame supporting a length of said chute; and (b) a back frame pivotally connected to said longitudinal frame to enable relative pivoting therebetween about a vertical axis, said back frame forming said back end of said frame means and supporting said back standard.

3. An apparatus as set forth in claim 1 and including:

(a) a defense bar connected to said front end of said frame means, said defense bar forming a barrier over which a shot with a basketball is made toward said goal assembly.

4. An apparatus as set forth in claim 3 wherein:

(a) said defense bar is vertically adjustable.

5. An apparatus as set forth in claim 1 and including:

(a) lateral support arms connected to said back standard and extending laterally from opposite sides thereof; and (b) said chute having a back end connected to said lateral arms in such a manner that an upper back end of said chute is spread below said goal assembly.

6. An apparatus as set forth in claim 1 and including:

(a) wheel means positioned on said frame means which engage said court surface to facilitate positioning said frame means relative to said goal assembly.

7. A basketball training apparatus for use with a conventional basketball goal assembly including hoop bracket means and comprising:

(a) an elongated chute frame having a front end and a back end;

(b) back frame means connected to said back end of said chute frame and supporting said back end above a court surface;

(c) a front frame connected to said front end of said chute frame and supporting said front end above said court surface;

(d) a back standard upstanding from said back frame;

(e) an elongated ball return chute member connected to said back standard and said chute frame and extending toward said front frame; and (f) hook means positioned at a top end of said back standard, said hook means being adapted for removable connection to said hoop bracket means.

8. An apparatus as set forth in claim 7 wherein:

(a) said back frame is pivotally connected to said chute frame to enable pivoting said chute frame relative to said back frame.

9. An apparatus as set forth in claim 7 and including:

(a) a middle frame connected to said chute frame at a position between said front frame and said back frame, said middle frame supporting a medial portion of said chute frame above said court surface.

10. An apparatus as set forth in claim 7 and including:

(a) a defense bar connected to said front frame, said defense bar forming a barrier over which a shot with a basketball is made toward said goal assembly.

11. An apparatus as set forth in claim 10 wherein:

(a) said defense bar is vertically adjustable.

12. An apparatus as set forth in claim 7 and including:

(a) lateral support arms connected to said back standard and extending laterally from opposite sides thereof; and (b) said chute having a back end connected to said lateral arms in such a manner that an upper back end of said chute is spread below said goal assembly.

13. An apparatus as set forth in claim 12 wherein:

(a) said back standard is pivotally supported by said back frame to enable said back standard to be pivoted about a vertical axis relative to said back frame whereby said lateral support arms are pivotable relative to said back frame.

14. An apparatus as set forth in claim 7 and including:

(a) wheel means positioned on said back frame and said front frame, said wheel means engaging said court surface to facilitate positioning said chute frame relative to said goal assembly.

15. A basketball training apparatus for use with a conventional basketball goal assembly including hoop bracket means and comprising:

(a) an elongated chute frame having a front end and a back end;

(b) back frame means pivotally connected to said back end of said chute frame to enable pivoting said chute frame relative to said back frame, said back frame supporting said back end above a court surface;

(c) a front frame connected to said front end of said chute frame and supporting said front end above said court surface;

(d) a back standard upstanding from said back frame;

(e) lateral support arms connected to said back standard and extending laterally from opposite sides thereof;

(f) an elongated ball return chute member having a back end connected to said lateral support arms and said chute frame and extending toward said front frame; and (g) hook means positioned at a top end of said back standard, said hook means being adapted for removable connection to said hoop bracket means.

16. An apparatus as set forth in claim 15 and including:

(a) a middle frame connected to said chute frame at a position between said front frame and said back frame, said middle frame supporting a medial portion of said chute frame above said court surface.

17. An apparatus as set forth in claim 15 and including:

(a) a defense bar connected to said front frame, said defense bar forming a barrier over which a shot with a basketball is made toward said goal assembly.

18. An apparatus as set forth in claim 17 wherein:

(a) said defense bar is vertically adjustable.

19. An apparatus as set forth in claim 15 wherein:

(a) said back standard is pivotally supported by said back frame to enable said back standard to be pivoted about a vertical axis relative to said back frame whereby said lateral support arms are pivotable relative to said back frame.

20. An apparatus as set forth in claim 15 and including:

(a) wheel means positioned on said back frame and said front frame, said wheel means engaging said court surface to facilitate positioning said chute frame relative to said goal assembly.

* * * * *